US008540019B2

(12) United States Patent
Hofman et al.

(10) Patent No.: US 8,540,019 B2
(45) Date of Patent: Sep. 24, 2013

(54) FRACTURING SYSTEM AND METHOD

(75) Inventors: Raymond Hofman, Midland, TX (US); Steve Jackson, Richmond, TX (US); Daniel Jesus Rojas, Cypress, TX (US); William Sloane Muscroft, Midland, TX (US)

(73) Assignee: Summit Downhole Dynamics, Ltd

( * ) Notice: Subject to any disclaimer, the term of this patent is extended or adjusted under 35 U.S.C. 154(b) by 324 days.

(21) Appl. No.: 12/909,446

(22) Filed: Oct. 21, 2010

(65) Prior Publication Data

US 2012/0097397 A1 Apr. 26, 2012

(51) Int. Cl.
*E21B 43/26* (2006.01)
*E21B 34/06* (2006.01)

(52) U.S. Cl.
USPC ..... 166/177.5; 166/308.1; 166/332.4; 166/386

(58) Field of Classification Search
USPC ..... 166/308.1, 373, 386, 177.5, 331, 166/332.8, 332.4
See application file for complete search history.

(56) References Cited

U.S. PATENT DOCUMENTS

| | | | | |
|---|---|---|---|---|
| 5,636,661 | A * | 6/1997 | Moyes | 137/614.2 |
| 6,209,663 | B1 * | 4/2001 | Hosie | 175/57 |
| 6,889,771 | B1 * | 5/2005 | Leising et al. | 166/373 |
| 6,892,816 | B2 * | 5/2005 | Pringle et al. | 166/320 |
| 7,168,492 | B2 * | 1/2007 | Laplante et al. | 166/319 |
| 7,168,493 | B2 * | 1/2007 | Eddison | 166/334.4 |
| 7,270,191 | B2 * | 9/2007 | Drummond et al. | 166/386 |
| 7,363,980 | B2 * | 4/2008 | Pringle | 166/319 |
| 7,712,538 | B2 * | 5/2010 | Fay | 166/332.4 |
| 8,191,631 | B2 * | 6/2012 | Clem et al. | 166/278 |
| 8,201,633 | B2 * | 6/2012 | Hilliard | 166/332.8 |
| 8,210,258 | B2 * | 7/2012 | O'Malley et al. | 166/250.15 |
| 8,235,114 | B2 * | 8/2012 | Clem et al. | 166/278 |
| 2004/0026085 | A1 * | 2/2004 | Vacik et al. | 166/373 |
| 2004/0129423 | A1 * | 7/2004 | Eddison | 166/321 |
| 2005/0224234 | A1 * | 10/2005 | Drummond et al. | 166/386 |
| 2007/0187107 | A1 * | 8/2007 | Pringle | 166/319 |
| 2008/0302538 | A1 * | 12/2008 | Hofman | 166/373 |
| 2011/0147006 | A1 * | 6/2011 | O'Malley et al. | 166/373 |
| 2011/0147007 | A1 * | 6/2011 | O'Malley et al. | 166/373 |
| 2012/0006553 | A1 * | 1/2012 | Korkmaz | 166/332.8 |
| 2012/0085548 | A1 * | 4/2012 | Fleckenstein et al. | 166/373 |
| 2012/0097397 | A1 * | 4/2012 | Hofman et al. | 166/308.1 |
| 2012/0199364 | A1 * | 8/2012 | Frosell | 166/373 |

* cited by examiner

*Primary Examiner* — Jennifer H Gay

(57) ABSTRACT

A system and method comprising at least one ported sleeve assembly and a flapper assembly positioned downwell of the ported sleeve assembly. The system provides for the use of multiple ported sleeve assemblies for each stage of a hydrocarbon producing well that can be opened with a single element, and multiple stages, each have the ability to be opened with a single element size.

19 Claims, 10 Drawing Sheets

FRACTURING SYSTEM AND METHOD

CROSS-REFERENCES TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates to oil and natural gas production. More specifically, the invention is a system and method for fracturing one or more stages of a hydrocarbon-producing well.

2. Description of the Related Art

In hydrocarbon wells, fracturing (or "fracing") is a technique used by well operators to create and extend fractures from the wellbore into the surrounding formation, thus increasing the surface area for formation fluids to flow into the well. Fracing is typically accomplished by either injecting fluids into the formation at high pressure (hydraulic fracturing) or injecting fluids laced with round granular material (proppant fracturing) into the formation. In either case, the fluids are pumped into the tubing string and into the formation though ports disposed in downhole tools, such as fracing valves.

Fracing multiple-stage production wells requires selective actuation of these downhole tools to control fluid flow from the tubing string to the formation. For example, U.S. Pat. No. 7,926,571, entitled Cemented Open Hole Selective Fracing System, describes one such system for selectively actuating a fracing sleeve using a shifting tool. The tool is run into the tubing string and engages with a profile within the interior of the valve. An inner sleeve may then be moved to an open position to allow fracing or to a closed position to prevent fluid flow to or from the formation.

The most common type of multiple stage fracturing system is the "ball-and-seat"-type system. Ball-and-seat systems are simpler actuating mechanisms than shifting tools and do not require running such tools thousands of feet into the tubing string. Most ball-and-seat systems allow a one-quarter inch difference between sleeves and the inner diameters of the seats of the valves within the string. For example, in a 4.5-inch liner, it would be common to drop balls from 1.25-inches in diameter to 3.5-inches in diameter in one-quarter inch or one-eighth inch increments, with the smallest ball seat positioned in the last valve in the tubing string.

Although ball-and-seat systems are commercially well-established, such systems have inherent drawbacks. While this methodology provides for a quick and relatively cheap solution (in terms of component cost) to open a fracing sleeve, the operator is saddled with inner dimension (ID) restrictions because the ball sizes start out small and progressively work upwell to the largest size.

First, the operator must drop balls of differing sizes to shift the various sleeves. This, however, limits the number of valves that can be used in a given tubing string because each ball would only be able to actuate a single valve, and the size of the liner only provides for a set number of valves with differently-sized ball seats. In other words, because a ball must be larger than the ball seat of the valve to be actuated so that it can engage its corresponding seat, and each ball must also be smaller than the ball seats of all upwell valves so it can pass through them as it travels through the tubing string to its corresponding seat, each ball can only actuate one tool.

Second, producers want to minimize, or altogether eliminate, ID restrictions in order to alleviate and simplify any remedial work that might be required. To achieve this with ball-and-seat systems, operators are forced to drill out the ball seats after fracing, which is very costly and time consuming. Moreover, this methodology presents a number of secondary issues, such as the inherent difficulty of working on a "charged" wellbore after fracing, wearing out mills and having to continuously trip the assembly out of the hole due to the number of sleeves to drill out, having to deal with sand, and the mechanical risk of a tool getting stuck in the hole with the drill out pipe or coil tubing, just to name a few. Such difficulties can increase costs from tens of thousands to hundreds of thousands of dollars.

Third, conventional ball-and-seat systems limit the flow rate of the fracing material within the tubing string. Operators want to maximize pump rates through the fracing system to treat the wellbore in the most efficient manner and get the most extension of fluids and fracing materials into the formation, which thereby increases production. But despite the large number of stages currently desired—modern multiple-stage wells typically run upwards of twenty-four stages—and working in the casing and open hole design sizes, there is only so much cross sectional area to work with.

The smaller balls and corresponding seats in these large systems are required to hold high pressure—usually ten thousand or more psi—which places design constraints on the engagement or contact area with current materials to ensure the ball does not crack, break, or extrude through the ball seat. Finding a ball material and preferred size that allows for the maximum amount of stages and uses the smallest engagement clearance possible requires use of stronger ball materials and affects impact reliability and the ability to drill out the balls following fracing.

Once all these parameters are allowed for, the smallest ball seat size in most cases ends up being as small as one inch in diameter, which can potentially cause premature opening of the sleeve as a result of fracing fluid moving through the sleeve at high flow rates. In order to avoid erosion of the seat and to ensure that the friction and pressure drop of the fracing fluid does not prematurely open or shift the ball seat without a ball, operators are forced to lower their pump rates through the smaller seats at the lower end of the well.

Fourth, these systems are unable to duplicate the "cemented plug and perf"-type completions that have multiple stages per well and in which a well operator perforates multiple clusters of holes for each stage. Operators desire and have proven the effectiveness of this method in that it allows for multiple fluid exit points for each stage and multiple fluid production points, which is important in order to fully and effectively fracture the formation for each stage. As the formation is treated through a single fluid exit point, the rock may break down a significant distance down the wellbore, forcing the fluid to exit the casing and turn the corner in the annulus. This causes near wellbore tortuosity, which in some cases causes premature screen out. It also increases erosion possibilities and problematic friction pressures.

Although some systems are under development to allow for a single ball of each size to open multiple injection points, each of the current systems still relies on using different sizes and have design concerns inherent to their approach. Furthermore, as mentioned supra, current "cemented plug and perf"-type completions utilize pump down composite or similar material plugs, which are set between the zones to stop fluid from fracing into the previous stage. This is costly both in resources and time because it requires the operator to stop fracing during the plug-setting operation, resulting in standby charges for the fracing equipment and increasing completion time from hours to days, or even weeks. This increases the overall cost exponentially without even considering the lost production that could have been made in that time period as well.

BRIEF SUMMARY

The present invention addresses these and other problems associated with the ball-and-seat type fracing systems described supra. The system of the present invention is comprised of at least one ported sleeve assembly, but provides for the use of multiple ported sleeve assemblies for each stage that can be opened with a single wiper ball, and multiple stages, each having the ability to be opened with a single ball size.

One embodiment of the system of the present invention comprises at least one ported sleeve assembly and a flapper assembly positioned downwell of the ported sleeve assembly. Each ported sleeve assembly comprises a ported housing having a plurality of ports disposed radially therethrough; a first sleeve at least partially within the ported housing and moveable between a first position and a second position, wherein in the first position the first sleeve is radially positioned between the plurality of ports and the flowpath. The first sleeve has an exterior surface, a first slot formed in the first exterior surface, and a first engagement surface having a first inner diameter. A first guiding member is fixed relative to the ported housing and positionable within the first slot. A first compression spring is positioned between the upper end of the first sleeve and the ported housing, the first compression spring being under compression when the first sleeve is in the first position. The flapper assembly comprises a flapper seal; a flapper plate rotatable between an opened position and a closed position, wherein in the opened position fluid flow in the downwell direction through the flapper seal is at least substantially unimpeded, and wherein in the closed position the flapper plate is engaged against the flapper seal to at least substantially prevent fluid flow through the flapper seal in the downwell direction; a second sleeve moveable between a first position and a second position, wherein in the first position at least a portion of the second sleeve is radially positioned between the flapper plate and the flowpath, the second sleeve having a second exterior surface, a second slot formed in the second exterior surface, and a second engagement surface having a second inner diameter; a second guiding member fixed relative to the flapper seal and positionable within the second walking jay slot; and a second compression spring positioned between an upper end of the second sleeve and the flapper seal, the second compression spring being under compression when the second sleeve is in the second position.

BRIEF DESCRIPTION OF THE SEVERAL VIEWS OF THE DRAWINGS

FIG. 3A is an isometric view of the flapper assembly shown in FIG. 1.

DETAILED DESCRIPTION OF THE INVENTION

When used with reference to the figures, unless otherwise specified, the terms "upwell," "above," "top," "upper," "downwell," "below," "bottom," "lower," and like terms are used relative to the direction of normal production through the tool and wellbore. Thus, normal production of hydrocarbons results in migration through the wellbore and production string from the downwell to upwell direction without regard to whether the tubing string is disposed in a vertical wellbore, a horizontal wellbore, or some combination of both. Similarly, during the fracing process, fracing fluids move from the surface in the downwell direction to the portion of the tubing string within the formation.

Figure 1:
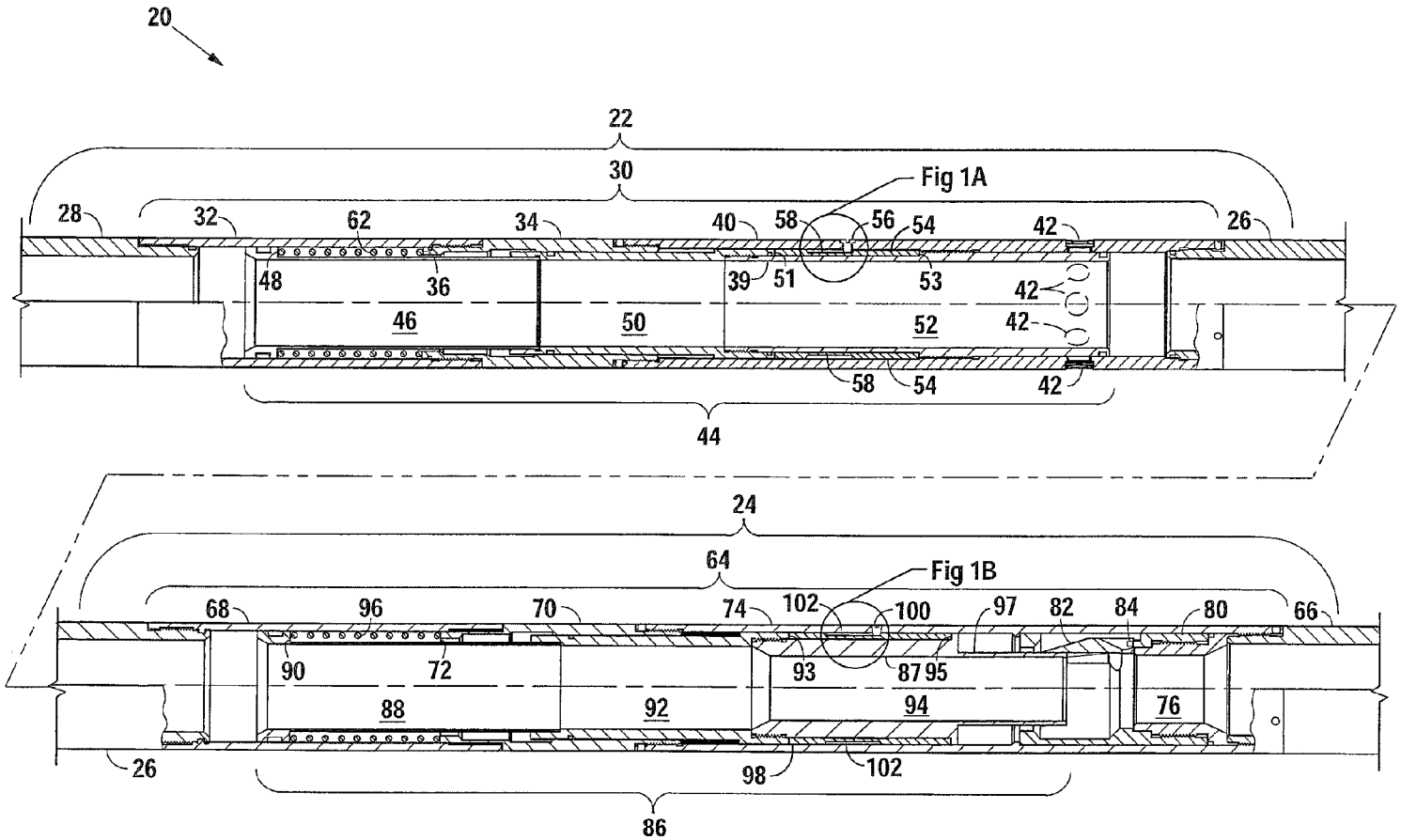
FIG. 1 is a sectional side elevation of a preferred embodiment of the apparatus of the present invention in a neutral state.

FIG. 1 depicts the preferred embodiment 20 of the present invention, which comprises a normally-closed ported sleeve assembly 22 located upwell from an associated normally-open flapper assembly 24. A tubing string section 26 provides a fluid communication path between the ported sleeve assembly 22 and the flapper assembly 24.

The ported sleeve assembly 22 and the flapper assembly 24 each can transition between three states: (i) a neutral state, which is shown in FIG. 1; (ii) a "shifted" state, as shown in and described with reference to FIG. 4; and (iii) an "actuated" state, as shown in and described with reference to FIG. 5. When used with reference to a normally-closed ported sleeve assembly, "actuated" means that the ports are opened to allow radial flow. When used with reference to a normally-open flapper assembly, "actuated" means closed.

The ported sleeve assembly 22 comprises a top connection 28 threaded to a first housing assembly 30 that includes a spring housing 32, a seal housing 34 having an annular upper end 36, and a ported housing 40. A plurality of radially-aligned ports 42 is disposed through the ported housing 40 to provide a fluid communication path between the interior of the ported sleeve assembly 22 and the surrounding formation.

A first sleeve 44 is nested and moveable longitudinally within the first housing assembly 30. The first sleeve 44 comprises a spring mandrel 46 having an annular shoulder 48 located at the upper end of the sleeve 44, and an upper seal mandrel 50 having an annular lower end 51. An upper compression spring 62 is positioned within an annular volume defined by the annular shoulder 48 and the annular upper end 36 of the seal housing 34. In the neutral position shown in FIG. 1, the compression spring 62 is under approximately three-hundred pounds of compression.

The first sleeve 44 further comprises a lower seal mandrel 52 having an annular middle shoulder 53, and an annular slotted member 54 positioned around the lower seal mandrel 52 and fixed longitudinally between the lower end 51 of the upper seal mandrel 50 and the middle shoulder 53. The slotted member 54 fits snugly around the lower seal mandrel 52, but is freely rotatable thereabout. The first sleeve 44 has an annular inner engagement surface 39 that will seal with an appropriately sized wiper ball, as will be described infra.

Figure 1A:
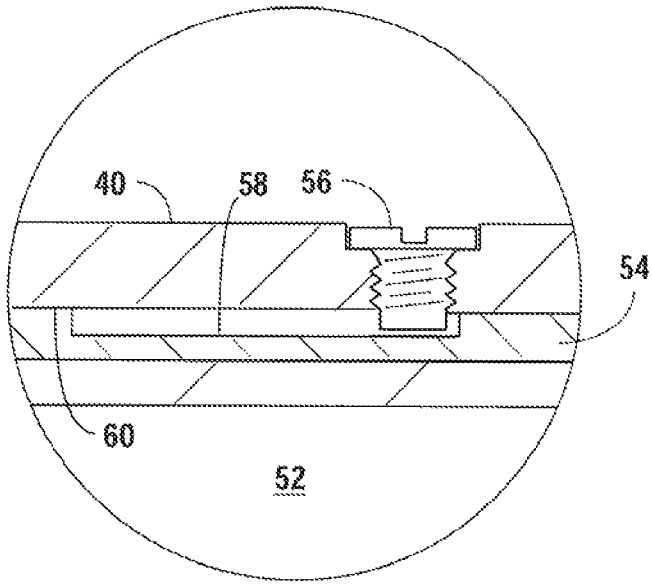
FIGS. 1A and 1B are enlarged views of portions of FIG. 1.

As shown in FIG. 1A, a guiding member, such as a torque pin 56, is fixed relative to, and extends through, the ported housing 40. The torque pin 56 is positioned within a walking jay slot 58 formed in the exterior surface 60 of the slotted member 54.

Figure 2A:
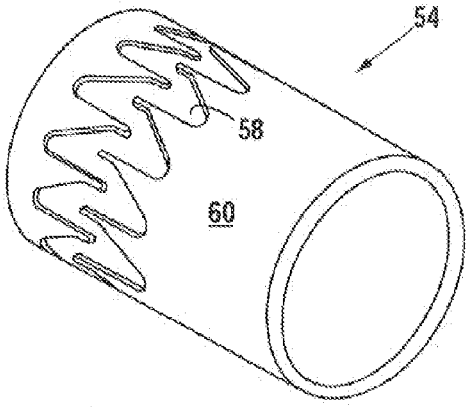
FIGS. 2A and 2B are isometric front and rear views of the upper slotted member shown in FIG. 1.
Figure 2B:
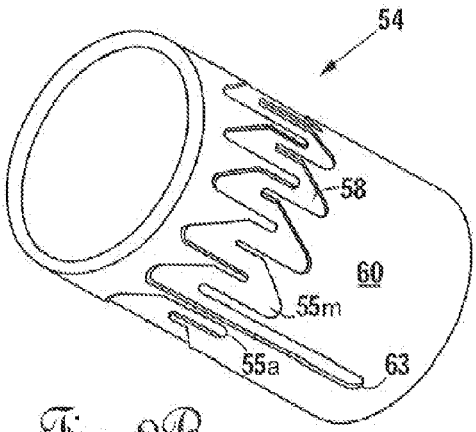
Figure 2C:
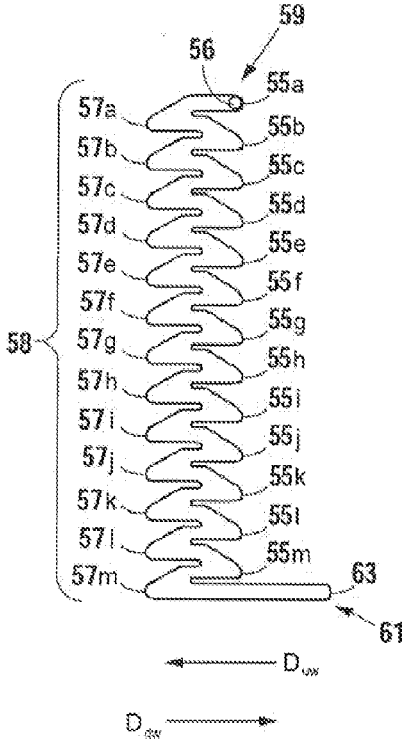
FIG. 2C shows the footprint of the slot formed in the exterior surface of the slotted member shown in FIGS. 2A and 2B.

FIGS. 2A-2C show the slotted member 54 and walking jay slot 58 in more detail. The walking jay slot 58 is a continuous path extending around and formed in the exterior surface 60 of the slotted member 54. The slot 58 is formed of a repeated pattern of thirteen neutral positions 55*a*-55*m* and thirteen shifted positions 57*a*-57*m*. A first end 59 of the slot 58 terminates in the first neutral position 55*a*. A second end 61 of the slot 58 terminates with an actuated position 63 positioned downwell of the neutral positions 55*a*-55*m*.

The slot 58 is shaped so that when the upper torque pin 56 is in a neutral position and the upper slotted member 54 moves downwell relative to the ported housing 40 (in direction $D_{dw}$), the upper torque pin 56 moves, relative to the slotted member 54, toward the adjacent shifted position. For example, when the torque pin 56 is in the first neutral position 55*a* and the slotted member 54 moves in direction $D_{dw}$, the torque pin 56 travels along the slot 58 to the first shifted position 57*a*, where further downwell movement of the slotted member 54 is impeded. When the upper torque pin 56 is in a shifted position, such as the first shifted position 57*a*, and the slotted member 54 moves upwell in direction $D_{uw}$, the upper torque pin 56 travels toward the next adjacent neutral position, which is the second neutral position 55*b*, or, if the torque pin 56 is at the thirteenth shifted position 57*m*, to the actuated position 63 as shown in FIG. 2C.

Referring again to FIG. 1, a second housing assembly 64 is connected to the tubing string section 26 and a bottom connection 66. The second housing assembly 64 comprises a spring housing 68, a seal housing 70 having an annular upper end 72, and a lower housing 74.

A flapper seal 76 is nested within the lower housing 74 and is adjacent to and upwell of the bottom connection 66. The flapper seal 76 is connected to a flapper mount 80. A flapper plate 82 is rotatably attached to the flapper mount 80 and rotatable about a pivot pin 84 between an opened position and a closed position. In the opened position, the flowpath within the second housing assembly 64 is unobstructed by the flapper plate 82. In the closed position, the flapper plate 82 engages the flapper seal 80 to prevent downwell flow, but allows fluid to pass the flapper plate 82 in the upwell direction.

A second sleeve 86 is nested, and longitudinally moveable, within the second housing assembly 64. The second sleeve 86 comprises a spring mandrel 88 having an annular upper shoulder 90 positioned at the upper end of the second sleeve 86, an upper seal mandrel 92 having an annular lower end 93, and a lower seal mandrel 94 having an annular middle shoulder 95. A compression spring 96 is positioned between the annular upper shoulder 90 of the spring mandrel 88 and the upper end 72 of the seal housing 70. In the neutral position shown in FIG. 1, the lower compression spring 96 is under approximately three hundred pounds of compression. The second sleeve 86 has an annular inner engagement surface 87 that will seal with an appropriately sized wiper ball. The engagement surfaces 39, 87 are sized and shaped to seal with the same wiper ball.

Figure 1B:
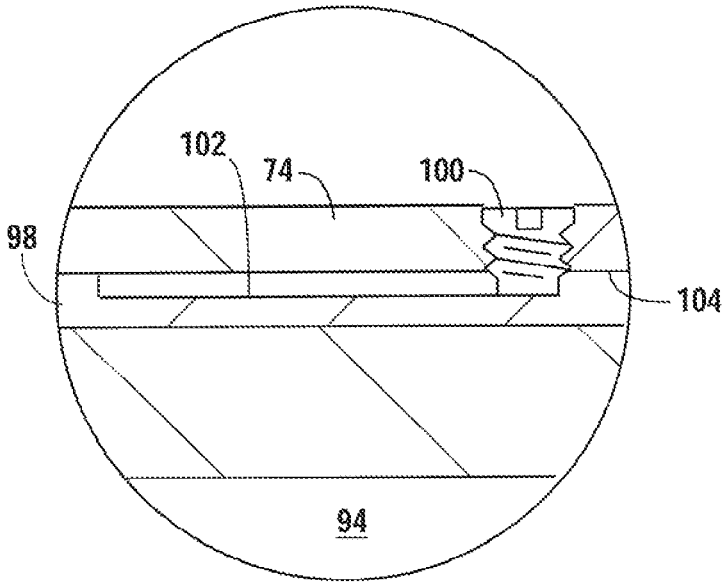

A slotted member 98 fits snugly around the lower seal mandrel 94, but is freely rotatable thereabout. The slotted member 98 is positioned and longitudinally fixed between the lower end 93 of the upper seal mandrel 92 and the middle shoulder 95 of the lower seal mandrel 94. A lower portion 97 of the lower mandrel 94 has an outer diameter smaller relative to the remainder of the sleeve 86, which lower portion 97 is sized to fit into an upper opening of the flapper seal 82 and support the flapper plate 82 in an opened position. A lower guiding member, such as a torque pin 100, is fixed relative to, and extends through, the lower housing 74, and is engaged with a lower walking jay slot 102 formed in the exterior surface 104 of the slotted member 98, as also shown in FIG. 1B.

FIG. 3A is a perspective view of the flapper assembly 24 shown in FIG. 1. The flapper seal 76 is threaded to a flapper mount 80. The flapper plate 82 is rotatably attached to the flapper mount 80 and rotatable about a pivot pin 84 between an opened position and a closed position. In the opened position shown in FIG. 3A, the flowpath is unobstructed by the flapper plate 82. In the closed position, the flapper plate 82 engages the flapper seal 76 to prevent downwell flow.

Figure 3B:
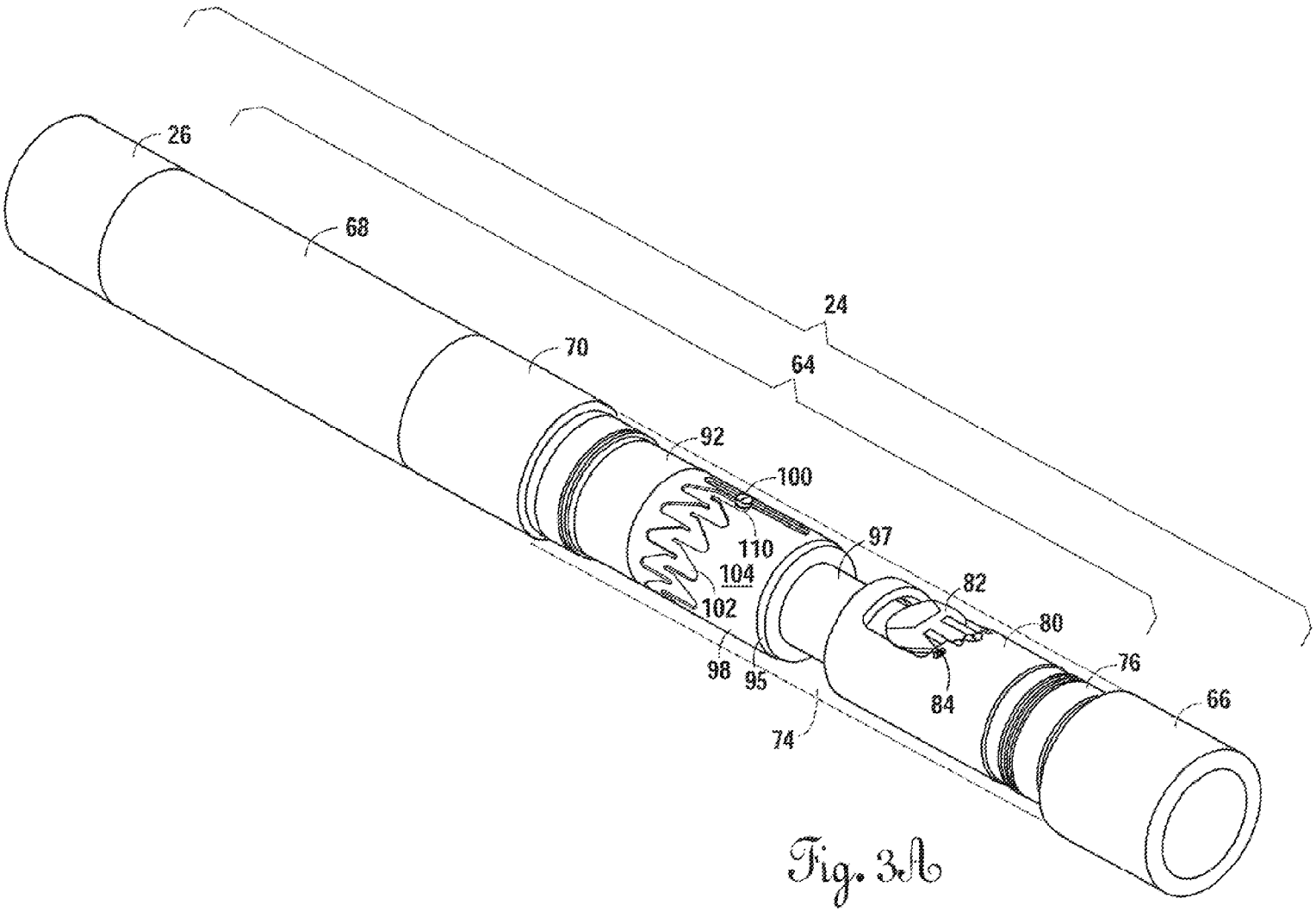
FIGS. 3B and 3C are isometric front and rear views of the lower slotted member shown in FIG. 3A.
Figure 3B:
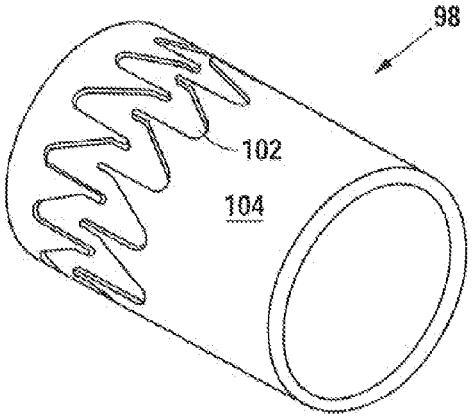
Figure 3C:
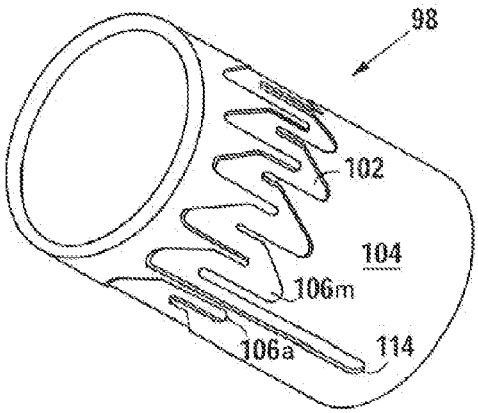
Figure 3D:
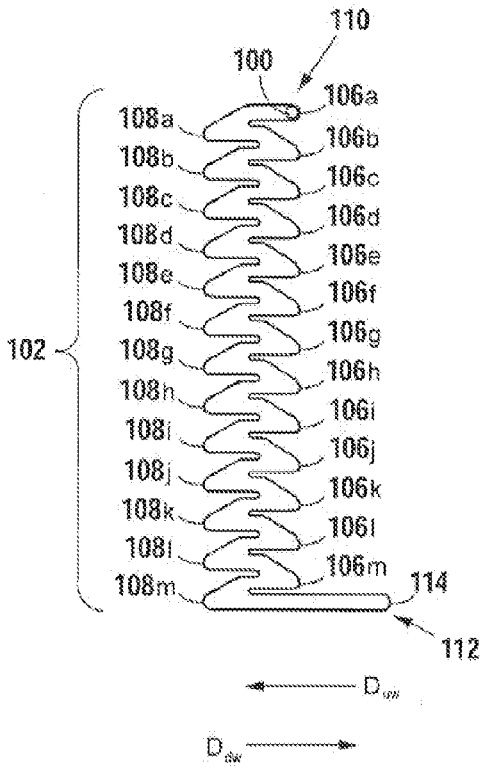
FIG. 3D shows the footprint of the slot formed in the exterior surface of the slotted member shown in FIGS. 3B and 3C.

As shown in FIGS. 3B-3D, the second walking jay slot 102 is a continuous path extending radially around and formed in the exterior surface 104 of the second slotted member 98. The second slot 104 is formed of a repeated pattern of thirteen neutral positions 106*a*-106*m* and thirteen shifted positions 108*a*-108*m*. A first end 110 of the second slot 102 terminates in the first neutral position 106*a*. A second end 112 of the second slot 102 terminates with an actuated position 114 positioned downwell of the neutral positions 106*a*-106*m*.

The second slot 102 is shaped so that when the lower torque pin 100 is in a neutral position and the slotted member 98 moves downwell relative to the flapper housing in direction $D_{dw}$, the torque pin 100 moves toward the adjacent shifted position. For example, when the torque pin 100 is in the first neutral position 106*a* and the slotted member 98 moves in direction $D_{dw}$, the torque pin 100 moves along the slot 102 to the first shifted position 108*a*, where further downwell movement of the slotted member 98 is impeded. When the lower torque pin 100 is in a shifted position, such as the first shifted position 108*a*, and the slotted member 98 moves upwell in direction $D_{uw}$, the torque pin 100 moves toward the next adjacent neutral position, which is the second neutral position 106*b*, or, if the torque pin 100 is at the last shifted position 108*m*, to the actuated position 114.

Operation of the embodiment 20 is initially described with reference to FIG. 1. During installation, the embodiment 20 is positioned in a wellbore with the first torque pin 56 positioned at the first end 59 of the first slot 58 (see FIG. 2C), which is in the first neutral position 55*a*, and with the second torque pin 100 positioned at the first end 110 of the second slot 102, which is in the first neutral position 106*a*. In this neutral state, the first sleeve 44 is positioned radially between the plurality of ports 42 and the flowpath to prevent fluid flow to and from the surrounding formation. The lower portion 97 of the lower seal mandrel 94 is positioned adjacent to and is in contact with the flapper plate 82. In this state, the flapper plate 82 is urged rotationally downward toward the flapper seal 76 by a torsion spring (not shown), but the lower portion 97 of the lower seal mandrel 94 impedes rotation of the flapper plate 82 to a closed position.

Figure 4:
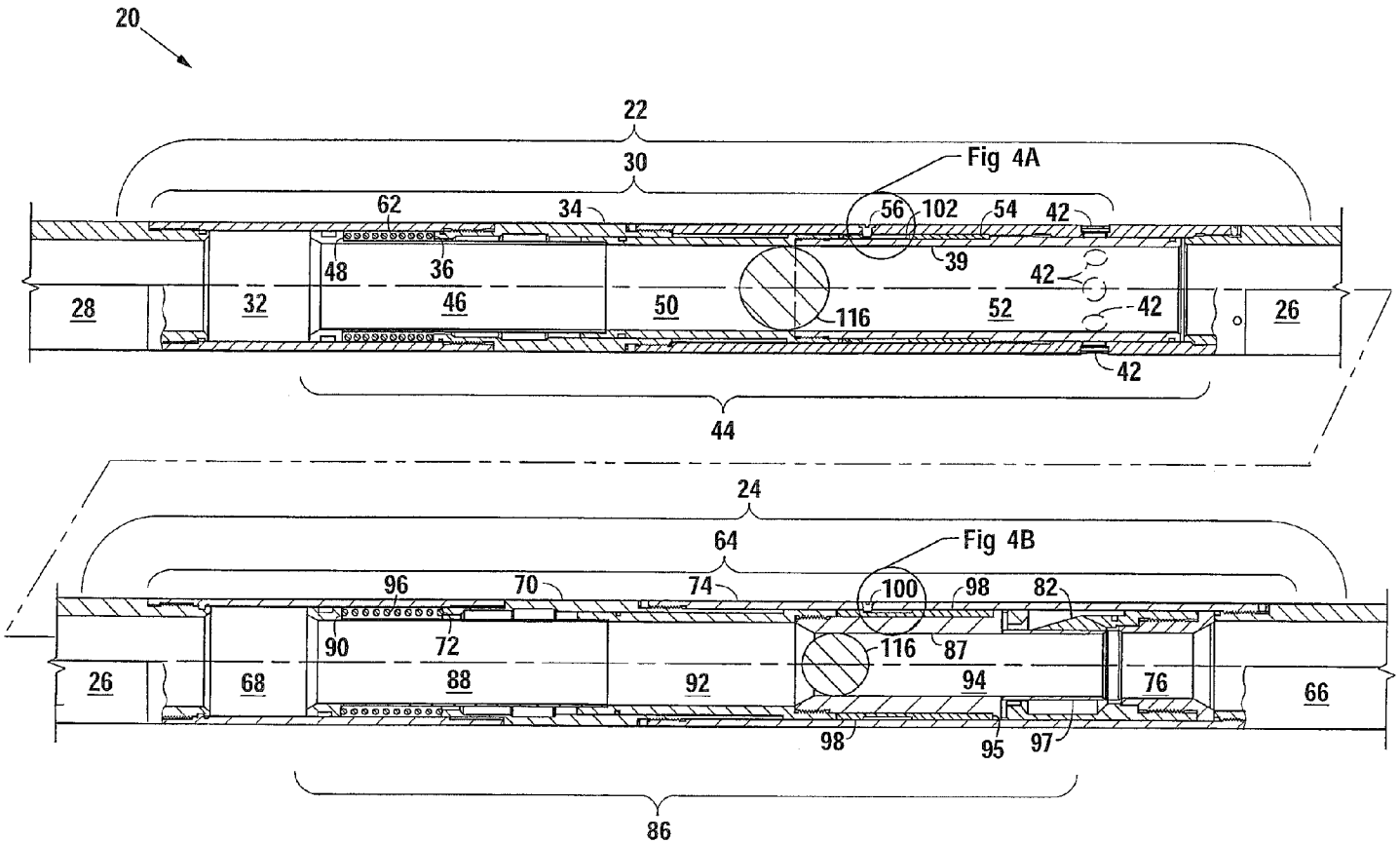
FIG. 4 is a side sectional elevation of the embodiment shown in FIG. 1 in a shifted state.
Figure 4A:
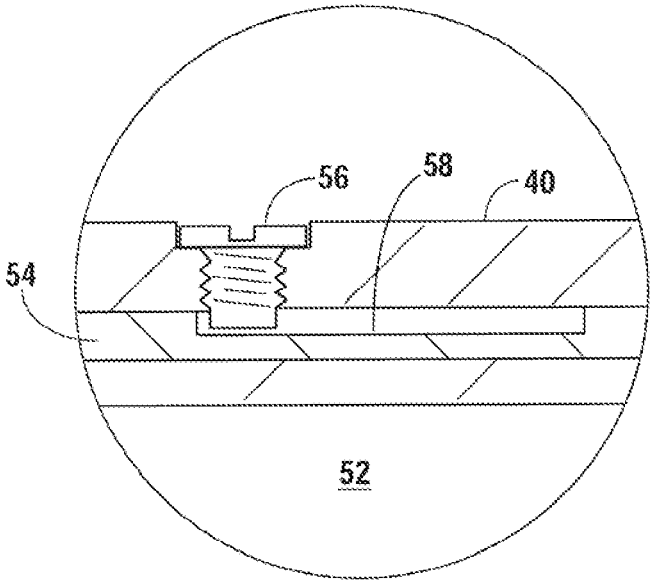
FIGS. 4A and 4B are enlarged views of portions of FIG. 4.
Figure 4B:
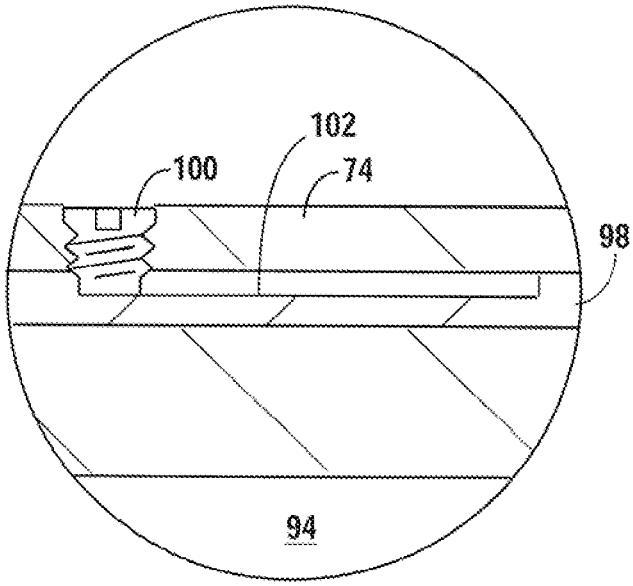

As shown in FIG. 4, to shift the embodiment 20, the well operator pumps a wiper ball 116 downwell to the embodiment 20. The wiper ball 116 is a rubber ball larger than the ID of the engagement surfaces 39, 87 of the first and second sleeves 44, 86. The wiper ball 116 seals to the engagement surface 39 of the first sleeve 44, thus creating a friction pressure against it. Although the expansive force of the compression spring 62 resists downwell movement of the first sleeve 44, when the pressure differential across the wiper ball 116 exceeds a first pressure differential, the expansive force of the compression spring 62 is overcome and the first sleeve 44 moves to the second position shown in FIG. 4, and the torque pin 56 moves to the next shifted position of the slotted member 54, depending on the position of the torque pin 56 within the slot 58 prior to shifting.

After the first sleeve 44 has shifted, the continued pressure differential will extrude the wiper ball 116 past the engagement surface 39 and through the first sleeve 44. The compression spring 62 will thereafter expand to return the first sleeve 44 to a neutral or the actuated position, depending on the position of the torque pin 56 within the slot 58 (see FIG. 2C).

The wiper ball 116 thereafter moves through the tubing string section 26 and seals against the engagement surface 87 of the second sleeve 86. When the pressure differential across the wiper ball 116 exceeds a second pressure differential, the expansive force of the compression spring 96 is overcome and the second sleeve 86 is shifted to the second position shown in FIG. 4 while the slotted member 98 is rotated to a shifted position relative to the torque pin 100, depending on the position of the torque pin 100 within the slot 102.

After the second sleeve 86 has shifted, the continued pressure differential will extrude the wiper ball 116 past the engagement surface 87 and through the second sleeve 86. The compression spring 96 will thereafter expand between the upper annular shoulder 90 and the seal housing 70 to return the second sleeve 86 to a neutral position or the actuated position, depending on the position of the torque pin 100 within the second slot 102 (see FIG. 3D).

As shown in FIG. 2C, the sequence described above is repeatable for the first sleeve 44 until the torque pin 56 reaches the thirteenth neutral position 55*m* of the upper slot 58*m*. Thereafter, the next wiper ball passing through the first sleeve 44 will cause the torque pin 56 to move to the thirteenth shifted position 57*m* of the first slot 58. After the wiper ball passes through the first sleeve 44 as described supra, the compression spring 62 will urge the spring return 46 upwell until the torque pin 56 moves to the actuated position 63.

As shown in FIG. 3D, the same wiper ball will then pass through the flapper assembly 24 and cause the second torque pin 100 to move to the thirteenth shifted position 108*m* of the slot 102. Thereafter, after the wiper ball passes through the second sleeve 86 as described supra, the compression spring 96 will urge the second sleeve 88 upwell until the torque pin 100 moves to the actuated position 114 of the slotted member 98.

Figure 5:
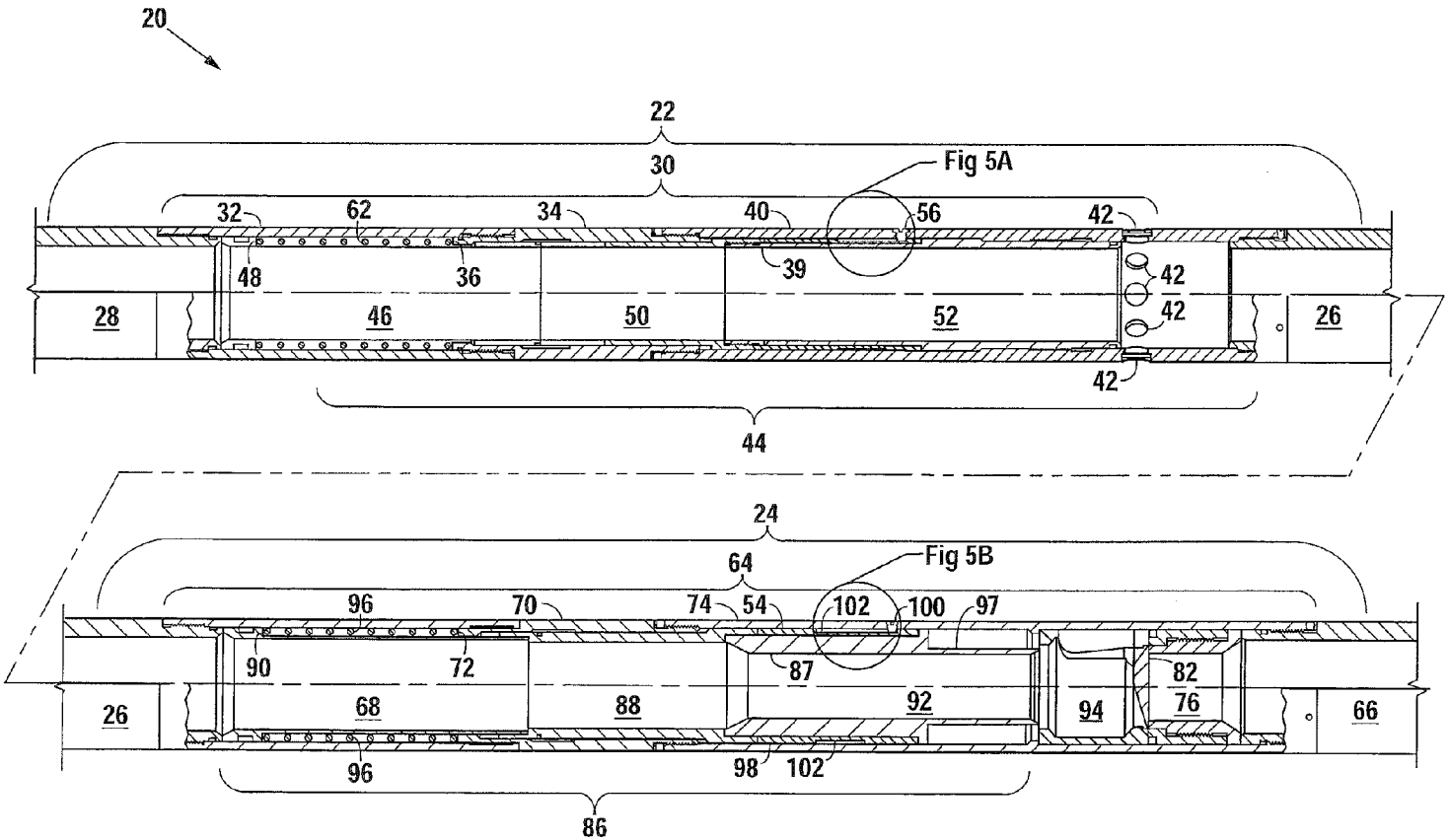
FIG. 5 is a side sectional elevation of the embodiment shown in FIG. 1 in an actuated state.
Figure 5A:
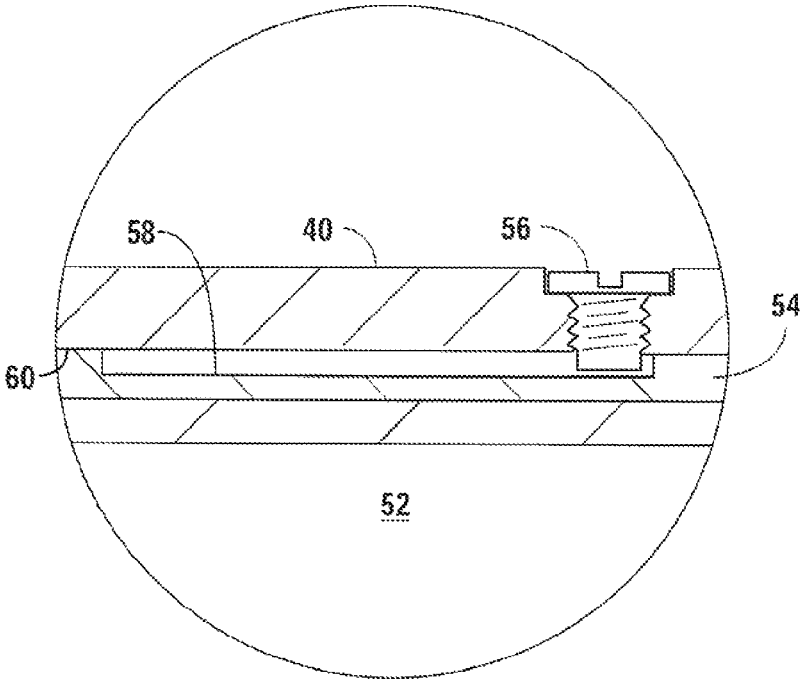
FIGS. 5A and 5B are enlarged views of portions of FIG. 5.
Figure 5B:
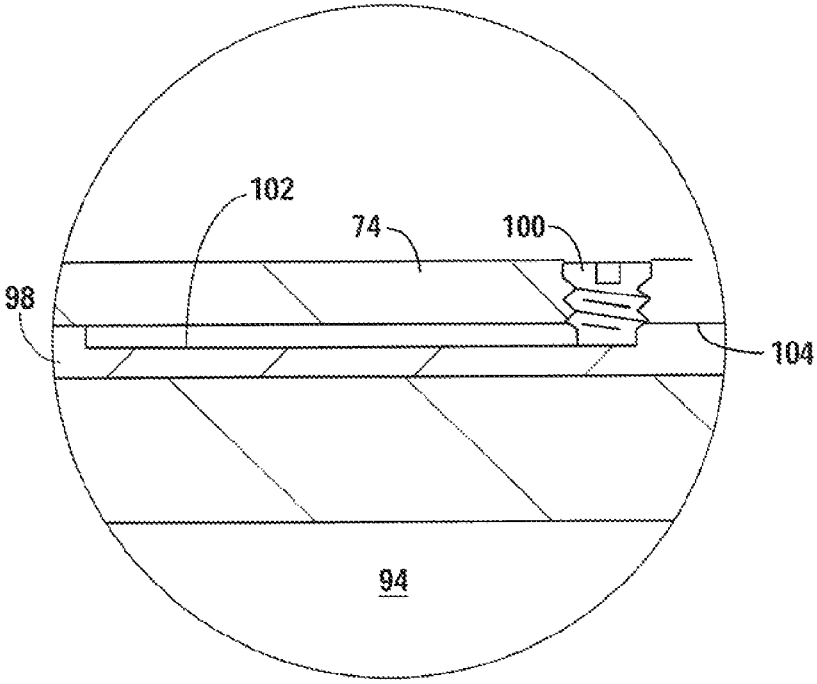

As shown in FIG. 5, when the first torque pin 56 is located in the actuated position 63 of the first slot 58, the first sleeve 44 is in a second position upwell of the plurality of ports 42, thereby permitting fluid flow into the surrounding formation from the flowpath. In this state, the compression spring 62 is under minimal, if any, compression.

Similarly, when the second torque pin 100 is located in the actuated position 114 of the slotted member 98, the second sleeve 86 is in a second position located upwell of the flapper plate 82. Because in this position the lower portion 97 of the lower seal mandrel 92 does not support the flapper plate 82 in the opened position shown in FIG. 1. and FIG. 4, the flapper plate 82 rotates to the closed position, which blocks fluid flow through the flapper seal 76. The compression spring 96 is under minimal, if any, compression.

Although the embodiment 20 as described above requires thirteen cycles to actuate the first and second sleeves 44, 86 to their second positions if the torque pins 56, 100 are initially positioned at the first ends 59, 110 of the first and second slots 58, 102, the number of shifting cycles until actuation may be reduced by positioning the embodiment 20 in the wellbore with the torque pins 56, 100 positioned in one of the intermediate neutral slot positions 55*b*-55*m*, 106*b*-106*m*. For example, the embodiment 20 may be preset to require only four shifting cycles by setting the torque pins 56, 100 to the tenth neutral positions 55*j*, 106*j* prior to installation in the tubing string. Thus, passage of the fourth wiper ball will actuate the sleeve assemblies 44, 86 to the second positions shown in FIG. 5.

Figure 6:
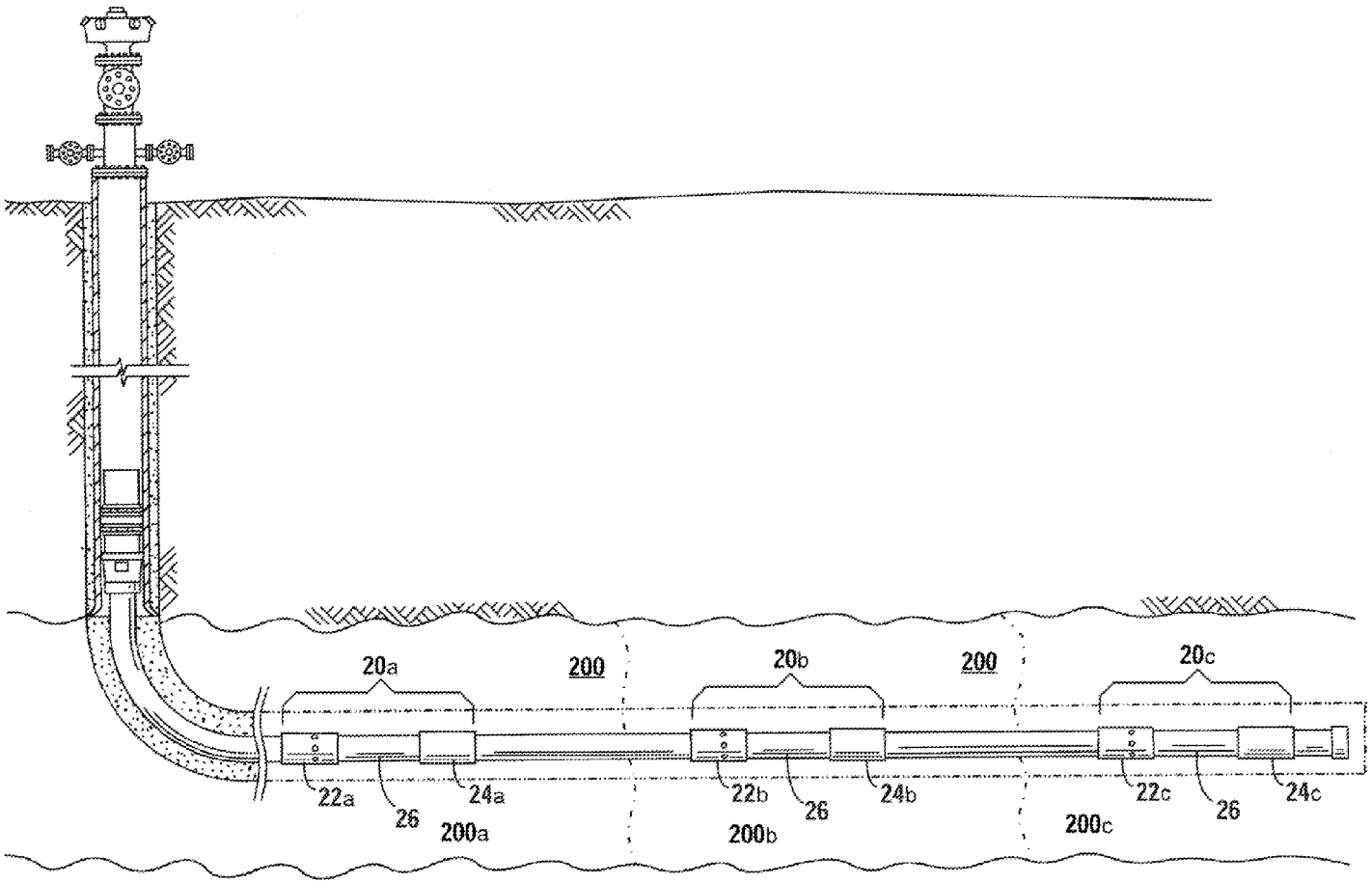
FIG. 6 is a side elevation of a system incorporating multiple tools of the preferred embodiment shown in FIG. 1.

FIG. 6 shows a system comprising three tools 20*a*-20*c* installed in a formation production well drilled in a hydrocarbon producing formation 200 that has three stages 200*a*-200*c*. Each of the tools 20*a*-20*c* comprises a ported sleeve assembly 22*a*-22*c* and a flapper assembly 24*a*-24*c* as described supra. Each of the tools 20*a*-20*c* is configured to require a different number of shifting cycles prior to actuating: the lower tool 20*c* is located in the lower stage 200*c* and is set to actuate after one shifting cycle (i.e., the guiding members are initially positioned in neutral positions 55*m* and 106*m* of FIGS. 2C and 3D, respectively); the middle tool 20*b* is located in the middle stage 200*b* and is set to actuate after two shifting cycles (i.e., the guiding members are initially positioned in neutral positions 55*l* and 106*l*); and the upper tool 20*a* is located in the upper stage 200*a* and is set to actuate after three shifting cycles (i.e., the guiding members are initially positioned in neutral positions 55*k* and 106*k*).

To fracture the surrounding formation 200, a first wiper ball is moved through the tubing string and tools 20*a*-20*c* as described supra. Because the lower tool 20*c* is set to only require one shifting cycle for actuation, the lower ported assembly 22*c* is opened to permit fluid flow into the surrounding formation 200, shortly after which the lower flapper assembly 24*c* is closed to prevent downwell flow. The area adjacent to the lowest tool 20*c* may thereafter be fraced by increasing and maintaining pressure against the closed flapper plate of the flapper assembly 20*c*.

When a second wiper ball is passed through the tubing string as described with reference to FIGS. 1-5, the middle ported assembly 22*b* is opened, shortly after which the middle flapper assembly 24*b* is closed. The area adjacent to the middle tool 20*b* may thereafter be fraced by increasing and maintaining pressure against the closed flapper plate of the middle flapper assembly 20*b*.

When a third wiper ball is passed through the tubing string as described with reference to FIGS. 1-5, the upper ported sleeve assembly 22*a* is opened and the upper flapper assembly 24*a* is closed. The area adjacent to the upper tool 20*a* may thereafter be fraced by increasing and maintaining pressure against the closed flapper plate of the upper flapper assembly 24*a*.

After fracturing, the well operator can produce hydrocarbons through the tools 20*a*-20*c* and downwell of the deepest tool 20*c* because the flapper assemblies 24*a*-24*c* allow fluid flow in the upwell direction without further manipulation by the operator. In alternative embodiments of the system, additional ported sleeve assemblies may be utilized within one or more stages 200*a*-200*c* to provide additional fracturing entry points into the surrounding formation 200.

In one embodiment of the system, the present invention increases the maximum number of stages from twenty-four for typical ball-and-seat systems to twelve stages for each ball size, or two hundred eighty-eight stages, which is both excessive and unnecessary for a typical producing well. In most embodiments, however, the operator uses only one or two different ball sizes that are as close to the maximum tubing string ID as possible in order to eliminate ID restrictions imposed by smaller seats. For example, a casing liner of 3.99 inches ID and a ball of 3.875 inches OD that mates to a sleeve of 3.75 inches ID, and having twelve stages of five sleeves per stage would allow for sixty ported sleeves to be treated sequentially. The 3.75 inch ID would not impose any significant flow restriction, thereby eliminating any need for drill out.

If the operator desires more than twelve independent stages, a second ball size can be used. Such a design, for example, would allow for a 3.625 inch OD ball mated to a 3.5 inch ID sleeve for the second set of sleeves, which would also, in most cases, eliminate the need for any drill out by the operator because of flow restrictions. This configuration would allow up to one-hundred twenty ported sleeves to be treated sequentially in stages utilizing two different ball sizes with no need to shut down between stages, thus maximizing time and cost efficiency, eliminating the need for any drill out, eliminating any of the associated mechanical risk, reducing the potential for production loss during the operation and operational costs, and ensuring that all ported sleeves are treated without the risk of breaking a ball prematurely and needing to treat stages twice.

Numerous other advantages also accrue from the present invention. For example, the present invention eliminates the need to pump down isolation devices, thus eliminating the potential for expensive remedial operations and downtime between treatments. Moreover, because the ported sleeve is not required to also serve as an isolation device and does not have to withstand the associated high pressures, a wider variety of ball materials may be used for expanding operational abilities of the system overall.

The present invention also increases system effectiveness and reduces mechanical risk, thereby increasing system reliability while lowering cost. Operators need not be concerned about impacting the shifting ball into a seat at too high of a rate or pressure, which would cause the ball or sleeve to fail. The invention also eliminates the risk of eroding the ball seat, which could potentially eliminate a solid pressure surface for the ball to seal against, resulting in potential system failure.

The present invention is described in terms of preferred embodiments in which specific system and methods are described. Those skilled in the art will recognize that alternative embodiments of such system, and alternative applications of the method, can be used in carrying out the present invention. Other aspects and advantages of the present invention may be obtained from a study of this disclosure and the drawings, along with the appended claims. Moreover, the recited order of the steps of the method described herein is not meant to limit the order in which those steps may be performed.

We claim:

1. A fracturing system for use in a production well having a tubing string defining a flowpath, the system comprising:

at least one sleeve assembly positionable in said tubing string, said at least one sleeve assembly comprising:

a housing having a plurality of ports disposed radially therethrough;

a first sleeve at least partially within said housing and moveable between a first position and a second position, wherein in said first position said first sleeve is radially positioned between said plurality of ports and said flowpath, said first sleeve having an upper end, a first exterior surface having a first walking jay slot formed therein, and a first engagement surface having a first inner diameter;

a first guiding member fixed relative to said housing and positionable within said first walking jay slot; and a first compression spring positioned between said upper end of said first sleeve and said ported housing; and a flapper assembly positionable in said tubing string downwell of said at least one ported sleeve assembly, said flapper assembly comprising:

a flapper seal;

a flapper plate rotatable between an opened position and a closed position, wherein in said closed position said flapper plate is engaged against said flapper seal to prevent fluid flow through said flapper seal in a downwell direction;

a second sleeve moveable between a first position and a second position, wherein in said first position at least a portion of said second sleeve is radially positioned between said flapper plate and the flowpath, said second sleeve having an upper end, a second exterior surface having a second walking jay slot formed therein, and a second engagement surface having a second inner diameter;

a second guiding member fixed relative to said flapper seal and positionable within said second walking jay slot; and a second compression spring positioned between said upper end of said second sleeve and said flapper seal.

2. The system of claim 1 wherein said first walking jay slot and said second walking jay slot comprise a plurality of neutral positions, a plurality of shifted positions, and an actuated position positioned downwell of said plurality of neutral positions.

3. The system of claim 2 wherein said first guiding member is positioned in a shifted position of said first walking jay slot when said first sleeve is in said first position, and wherein said first guiding member is positioned in said actuated positioned of said first walking jay slot when said first sleeve is in said second position.

4. The system of claim 2 wherein said second guiding member is positioned in a shifted position of said second walking jay slot when said second sleeve is in said first position, and wherein said second guiding member is positioned in said actuated positioned of said second walking jay slot when said second sleeve is in said second position.

5. The system of claim 1 further comprising:

a first annular shoulder at said upper end of said first sleeve;

a second annular shoulder at said upper end of said second sleeve;

wherein said first compression spring is located between said first annular shoulder and said ported housing; and wherein said second compression spring is located between said second annular shoulder and said flapper seal.

6. The system of claim 5 wherein said first sleeve comprises a first slotted member longitudinally fixed relative to said annular shoulder and radially rotatable relative to said ported housing, and wherein said first exterior surface is located on said first slotted member.

7. The system of claim 6 wherein said second sleeve comprises a second slotted member longitudinally fixed relative to said second annular shoulder and radially rotatable around said flowpath, and wherein said second exterior surface is located on said second slotted member.

8. The system of claim 1 wherein said first sleeve comprises: a lower seal mandrel; an upper seal mandrel fixed to said lower seal mandrel; and a spring mandrel fixed to said upper seal mandrel.

9. The system of claim 6 further comprising:

a spring housing;

a seal housing connected to and between said spring housing and said ported housing, said seal housing having an annular upper end positioned radially within said spring housing; and wherein said first compression spring is compressible between said annular upper end of said seal housing and an annular upper shoulder of said spring mandrel.

10. The system of claim 1 wherein said second sleeve comprises:

a lower mandrel having a lower portion and an annular middle shoulder;

an upper mandrel fixed to said lower mandrel and having an annular lower end;

a spring mandrel fixed to said upper mandrel; and a slotted member positioned rotatable around said lower mandrel and longitudinally fixed relative thereto between said middle shoulder and said lower end of said upper mandrel.

11. The system of claim 10 wherein in said first position said lower portion of said lower mandrel is positioned radially within said flapper plate.

12. The system of claim 10 further comprising:

a spring housing;

a lower housing positioned around said flapper seal;

a seal housing fixed to and between said spring housing and said lower housing, said seal housing having an annular upper end positioned radially within said spring housing; and wherein said second compression spring is compressible between said annular upper end of said seal housing and the annular shoulder of said spring mandrel.

13. A method of fracturing at least two stages of a multiple stage production well in a hydrocarbon-producing formation using at least one ported sleeve and at least one flapper assembly, wherein each of said at least one ported sleeve and at least one flapper assembly is configurable to actuate after a predetermined number of shifting cycles, the method comprising:

configuring a first group of at least one ported sleeve to actuate after a first quantity of shifting cycles;

configuring a second group of at least one ported sleeve to actuate after a second quantity of shifting cycles, wherein said second quantity of shifting cycles is greater than said first quantity of shifting cycles;

configuring a first flapper assembly to actuate after said first quantity of shifting cycles, said first flapper assembly having a first flapper plate engageable with a first flapper seal, and wherein said first flapper plate is orientated to prevent downwell fluid flow when engaged with said flapper seal;

configuring a second flapper assembly to actuate after said second quantity of shifting cycles, said second flapper assembly having a second flapper plate engageable with a second flapper seal, and wherein said second flapper plate is orientated to prevent downwell fluid flow when engaged with said flapper seal;

positioning said first flapper assembly in said production well;

positioning said first group of at least one ported sleeve in said production well upwell of said first flapper assembly;

positioning said second flapper assembly in said production well upwell of said first group;

positioning said second group of at least one ported sleeve in said production well upwell of said second flapper assembly;

shifting each of said first group of at least one ported sleeve, said second group of at least one ported sleeve, said first flapper assembly, and said second flapper assembly a first quantity of times; and shifting said second group and said second flapper assembly a third quantity of cycles, wherein said third quantity is equal to said second quantity less said first quantity.

14. The method of claim 13 wherein said step of shifting each of said first group of at least one ported sleeve comprises:

passing a first quantity of balls through said first flapper assembly, each of said balls being engageable with said first and second groups and said first and second flapper assemblies when a pressure differential across said ball is below a first threshold pressure, and each of said balls being moveable through said second group and said second flapper assembly when said pressure differential is above a second threshold pressure.

15. The method of claim 14 further comprising the step of:

passing a second quantity of balls past said second flapper assembly, each of said balls being engageable with each ported sleeve of said second group and said second flapper assembly when the pressure differential across the ball is below a first threshold pressure, and each of said balls being moveable through said second group and said second flapper assembly when said pressure differential is above a second threshold pressure.

16. The method of claim 13 further comprising the step of fracing the formation through said first group of at least one ported sleeve.

17. The method of claim 16 further comprising the step of fracing the formation through said second group of at least one ported sleeve.

18. A fracturing system for use in a production well, the system comprising:

at least one ported sleeve assembly circumscribing a first flowpath, said at least one ported sleeve assembly comprising:

a ported housing having a plurality of ports disposed therethrough;

a first sleeve at least partially within said ported housing and moveable between a first position and a second position, wherein in said first position said first sleeve is radially positioned between said plurality of ports and said first flowpath, said first sleeve having an end, a first exterior surface having a first walking jay slot formed therein, and a first engagement surface having a first inner diameter;

a first guiding member fixed relative to said ported housing and positionable within said first walking jay slot; and a first compression spring positioned between said end of said first sleeve and said ported housing, said first compression spring being under compression when said first sleeve is in said first position; and a flapper assembly circumscribing a second flowpath and adapted for fluid communication with said at least one ported sleeve assembly, said flapper assembly comprising:

a flapper seal;

a flapper plate rotatable between an opened position and a closed position, wherein in said closed position said flapper plate is engaged against said flapper seal to prevent fluid flow therethrough in one direction;

a second sleeve moveable between a first position and a second position, wherein in said first position at least a portion of said second sleeve is radially positioned between said flapper plate and said second flowpath, said second sleeve having an end, a second exterior surface having a second walking jay slot formed therein, and a second engagement surface having a second inner diameter;

a second guiding member fixed relative to said flapper seal and positionable within said second walking jay slot; and a second compression spring positioned between said end of said second sleeve and said flapper seal, said second compression spring being under compression when said second sleeve is in said first position.

19. A downhole tool for use in a production well and positionable in a tubing string defining a flowpath, the tool comprising:

a housing having a plurality of ports disposed radially therethrough;

a flapper seal;

a flapper plate rotatable between an opened position and a closed position, wherein in said closed position said flapper plate is engaged against said flapper seal to prevent fluid flow through said flapper seal in a downwell direction;

a sleeve at least partially within said housing and moveable between a first position and a second position, wherein in said first position a first portion of said sleeve is radially positioned between said plurality of ports and said flowpath and a second portion of said sleeve is radially positioned between said flapper plate and the flowpath, said sleeve having an upper end, an exterior surface having a walking jay slot formed therein, and an engagement surface having an inner diameter;

a guiding member fixed relative to said housing and positionable within said walking jay slot; and a compression spring positioned between said upper end of said sleeve and said housing.

* * * * *